United States Patent [19]

Rohner et al.

[11] Patent Number: 4,476,671

[45] Date of Patent: Oct. 16, 1984

[54] DEVICE FOR THE PARTIAL STRAIGHTENING AND PARALLELIZING OF THE FIBERS OF A THREAD OR THREAD END

[75] Inventors: Joachim Rohner; Heinz Zumfeld, both of Monchen-Gladbach, Fed. Rep. of Germany

[73] Assignee: W. Schlafhorst & Co., Monchen-Gladbach, Fed. Rep. of Germany

[21] Appl. No.: 437,252

[22] Filed: Oct. 28, 1982

[30] Foreign Application Priority Data

Oct. 31, 1981 [DE] Fed. Rep. of Germany ..... 3143263

[51] Int. Cl.[3] ..... D01H 15/00

[52] U.S. Cl. ..... 57/261; 57/22

[58] Field of Search ..... 57/22, 261, 263, 101, 57/346, 341

[56] References Cited

U.S. PATENT DOCUMENTS

| | | | |
|---|---|---|---|
| 2,990,674 | 7/1961 | Stoll et al. | 57/101 X |
| 3,903,680 | 9/1975 | Isern | 57/22 |
| 4,002,017 | 1/1977 | Weinz | 57/341 |
| 4,244,169 | 1/1981 | Ligones et al. | 57/22 |
| 4,356,688 | 11/1982 | Zurcher | 57/22 |
| 4,372,107 | 2/1983 | Hart | 57/346 |
| 4,386,494 | 6/1983 | Felix | 57/22 |

*Primary Examiner*—Donald Watkins

*Attorney, Agent, or Firm*—Herbert L. Lerner; Laurence A. Greenberg

[57] ABSTRACT

Device for the partial straightening and parallelizing of fibers of a thread or thread end, including a turbine being drivable by compressed gas, the turbine including a rotor being accessible from outside the turbine, the rotor having a central opening formed therein being coaxial with the axis of rotation of the rotor for receiving a thread or thread end.

16 Claims, 5 Drawing Figures

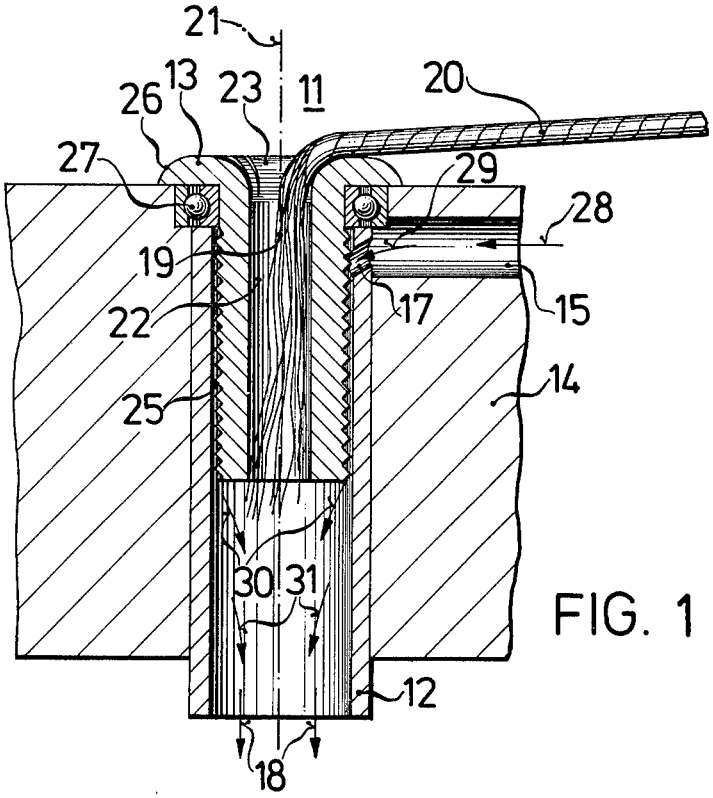
FIG. 1
FIG. 2
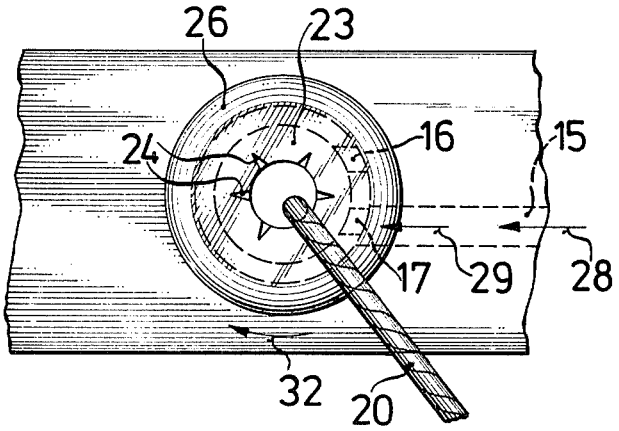

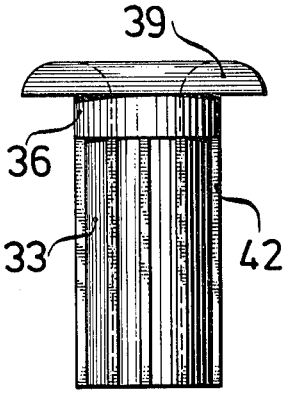
FIG. 3
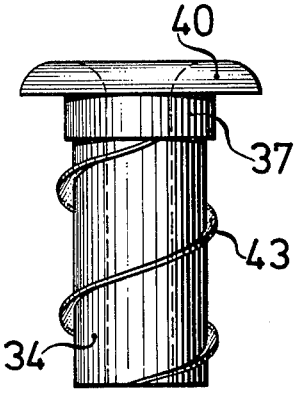
FIG. 4
FIG. 5
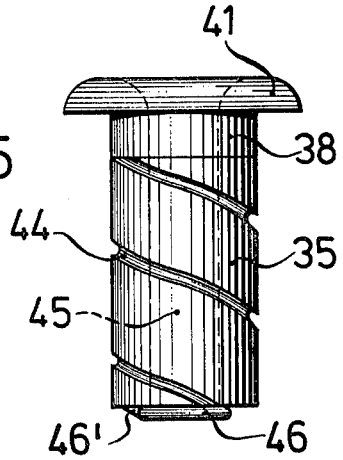

DEVICE FOR THE PARTIAL STRAIGHTENING AND PARALLELIZING OF THE FIBERS OF A THREAD OR THREAD END

The invention relates to a device for the partial straightening or stretching and parallelizing of the fibers of a thread or thread end. If two threads or thread ends are to be joined together, such as by splicing, it is necessary in certain cases to partially straighten and parallelize the fibers of the threads or thread ends first. In general, the threads have a thread twist which must be removed, so that the individual fibers lie in a position in which they are straightened as much as possible and are as close to parallel as possible.

It has already been attempted to achieve the straightening and parallelizing of the fibers by a rotating air stream. The result of these efforts has not been satisfactory, and furthermore, the amount of power required therefor is too large.

It is accordingly an object of the invention to provide a device for the partial straightening and parallelizing of the fibers of a thread or thread end, which overcomes the hereinafore-mentioned disadvantages of the heretofore-known devices of this general type, to partially straighten and parallelize the fibers of a thread or thread end with a small amount of power, and to ensure that the thread loses its thread twist in this partial region.

With the foregoing and other objects in view there is provided, in accordance with the invention, a device for the partial straightening and parallelizing of fibers of a thread or thread end, comprising a turbine being drivable by compressed gas, the turbine including a rotor being accessible from outside the turbine, the rotor having a central opening formed therein being coaxial with the axis of rotation of the rotor for receiving a thread or thread end.

This involves only a very small compressed-gas turbine of simple construction. The thread or thread end to be manipulated is introduced into the central opening and then, the rotor is set in rotation by a pulse of compressed gas. During the process, parts of the thread come to lie against the wall of the central opening and thus participate in the rotation with the result that the thread twist is separated or disentangled if the rotor rotates against the twist of the thread.

In accordance with another feature of the invention, the rotor has an entrance opening formed therein for the central opening, the entrance opening being expanded in the shape of a funnel for permitting or aiding rolling off of the thread. The idea here is to angle off the thread at the incoming end, so that it rests against the entrance opening that is expanded like a funnel and then can roll off during the rotation of the rotor. In this way, the thread twist is likewise separated or disentangled and the straightening and parallelizing of the fibers is improved. To enhance this effect, in accordance with a further feature of the invention, the rotor has a surface being roughened or uneven with irregularities at the entrance opening.

Especially in the case in which a low speed of rotation is desired, but also in the case in which the thread or the thread end is difficult to free of its twist because of finish, adhesive or the like, in accordance with still a further feature of the invention, there is provided a holding device disposed on the rotor at the exit of the central opening for the thread or thread end.

In accordance with a further feature of the invention, the central opening has an end, and the holding device is in the form of a flap resiliently closing the end of the central opening, the flap being temporarily openable by a compressed gas pulse applied to the central opening for introducing the thread or thread end. The flap may be formed, for instance, of a small rubber slab which is connected to the rotor at one edge. However, it may also be a flap which can be closed by spring-loading.

In order to assure that the rotor can exert an appropriate force on the thread or the thread end and to ensure that no unnecessary amount of power is consumed in the rotation, in accordance with yet a further feature of the invention, the rotor has an outer surface having regions of unevenness formed thereon. The unevennesses then form points of attack for the compressed gas.

In accordance with an added feature of the invention, the regions of unevenness are in the form of axially-directed elevations formed on or depressions formed in the outer surface. The compresses gas can then also flow off better along the elevations or depressions.

In accordance with an additional feature of the invention, the regions of unevenness are in the form of helical elevations formed on or depressions formed in the outer surface. A screw thread applied on the outside is also usable.

The stator of the turbine can be of very simple construction. Therefore, in accordance with again another feature of the invention, the turbine includes a tubular stator in which the rotor is inserted.

In accordance with again a further feature of the invention, the stator has at least one nozzle formed therein for conducting compressed gas to the rotor, the at least one nozzle having an orientation with a tangential and an axial component relative to the rotor. The nozzle is therefore directed against the rotor at an angle which ensures that it is forced to always rotate in the direction of rotation determined by the alignment of the nozzle; and in addition, the compressed gas is caused to flow off in a predetermined direction.

It is proposed for the stator to be longer than the rotor and to have an extended part which serves as a guide tube for the out-flowing compressed gas and the short fibers which may optionally be removed pneumatically. The stator therefore fulfills a double function.

A particularly light-weight turbine structure is obtained if the stator is movably supported on its base, which has at least one compressed-gas feed canal. The nozzle of the stator in this case is coincident with the compressed-gas feed canal. Replacing the stator raises no problems with this embodiment. Changing the stator may be necessary if threads of a different twist are to be processed.

However, changing the stator can be avoided if, in accordance with again a further feature of the invention, there is provided a compressed-gas feed canal, the at least one nozzle being in the form of a plurality of nozzles disposed along a peripheral curve of the stator for respectively causing clockwise and counterclockwise rotation of the rotor, the stator being rotatable for selectively bringing the nozzles into orientation with the feed canal.

In the simplest case, in accordance with again an added feature of the invention, the rotor has a thread entrance end having a flange-like enlargement formed thereon for support, overhanging the stator and preventing the rotor from slipping through the stator.

According to the explanations given above, an axially-directed force component occurs at the rotor during operation, which then pushes the flange-like enlargement against the stator, so that the rotor cannot slide out of the stator toward the opposite side either. However, in accordance with a concomitant feature of the invention, there are provided ball bearings supporting the rotor in the stator.

In summary, other advantages achieved with the invention are in particular that a well-proportioned partial straightening and parallelizing of the fibers is made possible with gentle treatment for any gauge and direction of the thread twist, for different fiber materials and different other boundary conditions of the thread or the thread ends.

Other features which are considered as characteristic for the invention are set forth in the appended claims.

Although the invention is illustrated and described herein as embodied in a device for the partial straightening and parallelizing of the fibers of a thread or thread end, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, cross-sectional view of a turbine;

FIG. 2 is a fragmentary top plan view of FIG. 1; and

FIGS. 3, 4 and 5 are elevational views of different rotor embodiments.

Referring now to the figures of the drawing and first particularly to the embodiment of the invention according to FIGS. 1 and 2 thereof, it is seen that the turbine which is designated in its totality with reference numeral 11, is formed of a tubular stator 12 and a rotor or traveler 13 which is acted upon from the outside. The turbine 11 can be driven with compressed gas.

The stator 12 is movably supported in a base 14 which includes a copressed-gas feed canal. For permitting selection of clockwise or counterclockwise rotation of the rotor 13, the stator 12 has nozzles 16 and 17 formed therein lying on a circumferential curve. By rotating the stator 12, one of the two nozzles can be selectably brought into coincidence with a compressed-gas feed canal 15. In the present embodiment example, the nozzle 17 has been brought into coincidence with the compressed-gas feed canal 15.

Both nozzles 16 and 17 are disposed in such a way that their orientation with respect to the rotor 13 has a tangential and an axial component. FIG. 2 shows that the nozzle 16 has a counterclockwise-rotating tangential component and that the nozzle 17 has a clockwise rotating tangential component.

The stator 12 is longer than the rotor 13 and has an extended part which at the same time serves as a guide tube for the compressed gas and the optionally pneumatically removed short fibers flowing off in the direction of the arrows 18.

The rotor 13 has a central opening 22 formed therein which lies in the axis of rotation 21 and receives the end 19 of a thread 20. The central opening is formed in this embodiment as a bore hole. The central opening 22 has an entrance opening 23 which is expanded in a funnel shape and permits or aids the unrolling or unwinding of the thread 20. The entrance opening 23 is roughened and is furthermore provided with regions 24 of unevenness which are in the form of notches. A total of six notches are provided.

On its outer surface, the rotor 13 has regions 25 of unevenness in the form of a screw thread. At the side at which the thread enters, the rotor 13 has a flange-like enlargement 26. The rotor 13 is supported at the stator 12 and in the base 14 by means of a ball bearing 27.

For the partial stretching and parallelizing of the fibers, the end 19 of the thread 20 is first introduced into the central opening 22 of the rotor 23. The thread 20 is then held so that it can roll off on the funnel-like expanded entrance opening 23. A compressed-gas pulse is then applied to the turbine 11 in the direction of the arrows 28 and 29 through the compressed gas feed canal 15, so that the rotor 13 is set in rotation. The compressed gas, which may be compressed air, flows off in the direction of the arrows 30 and 31.

With the cooperation of the stretched and parallelized fibers of the thread end 19 which unravels in the rotation, the rotor 13 is braked and then comes to a stop. While the rotor 13 rotates, the thread 20 rolls off on the entrance opening 23 which is expanded in a funnel shape, which results in an increase of the thread twist in the outer part of the thread 20 and a separation or disentanglement of the part of the thread end 19 in the central opening 22. These two effects of the rotation of the rotor 13 ultimately contribute to its being braked as well.

In the present embodiment example, the rotor 13 rotates in the direction of the curved arrow 32, and the thread 20 has an S-twist.

If, in another application, a thread with a Z-twist is to be processed, the rotor 13 must rotate in the opposite direction. To this end it is necessary to rotate the stator 12 far enough so that the nozzle 16 is aligned with the compressed-gas feed canal 15.

In the second embodiment example according to FIG. 3, the rotor 33 has a neck part 36 serving as a bearing, and a flange-like enlargement 39 which prevents the rotor from slipping through the stator. The rotor 33 is supported in the stator in an overhanging manner without the benefit of a ball bearing. The unevenness on the outer surface in this case is in the form of axially-directed rib-like elevations or bulges 42.

The rotor 34 according to FIG. 4 is also intended for an overhanging support in the stator. The rotor 34 has a collar or neck part 37 which provides a bearing-like support, and a flange-like enlargement 40. The unevenness on the outer surface in this case is in the form of a helical rib-like elevation or bulge 43.

The rotor 35 according to FIG. 5 is also supported in the stator in an overhanging manner. The overhanging assembly is accomplished by a neck part 38. A flange-like enlargement 41 prevents the rotor from slipping through the stator. The unevenness on the outer surface in this case is in the form of helically formed groove-like depressions 44.

A holding device for the thread or thread end is disposed at the exit of the central opening 45 of the rotor 35. This holding device is in the form of a flap which resiliently closes the end of the central opening 45. The flap 46 has an edge connected at a point 46' to the rotor 35. The flap 46 is formed of rubber-elastic material. For introducing a thread or a thread end, the flap 46 can be opened temporarily by a compressed-gas pulse applied to the central opening 45. The thread or the thread end is at the same time transported by the compressed-gas pulse and is held by the flap 46 after the compressed-gas pulse ceases. However, the flap 46 does not close the central opening 45 so strongly that the thread or the thread end cannot be pulled out again.

The foregoing is a description corresponding to German Application No. P 31 43 263.8, dated Oct. 31, 1981, the International priority of which is being claimed for the instant application, and which is hereby made part of this application. Any discrepancies between the foregoing specification and the aforementioned corresponding German application are to be resolved in favor of the latter.

We claim:

1. Device for the partial straightening and parallelizing of fibers of a thread or thread end in preparation for splicing in a thread splicing apparatus, comprising a turbine being drivable by compressed gas, said turbine including a rotor being accessible from outside said turbine, said rotor having a central opening formed therein being coaxial with the axis of rotation of said rotor for receiving a thread or thread end to be untwisted by rotation of said rotor and withdrawn after untwisting.

2. Device according to claim 1, wherein said rotor has an entrance opening formed therein for said central opening, said entrance opening being expanded in the shape of a funnel for rolling off of the thread.

3. Device according to claim 2, wherein said rotor has a surface being roughened at said entrance opening.

4. Device according to claim 1, including a holding device disposed on said rotor at said central opening for the thread or thread end.

5. Device according to claim 4, wherein said central opening has an end, and said holding device is in the form of a flap resiliently closing said end of said central opening, said flap being temporarily openable by a compressed gas pulse applied to said central opening for inroducing the thread or thread end.

6. Device according to claim 1, wherein said rotor has an outer surface having regions of unevenness formed thereon.

7. Device according to claim 6, wherein said regions of unevenness are in the form of axially-directed elevations formed on said outer surface.

8. Device according to claim 6, wherein said regions of unevenness are in the form of axially-directed depressions formed in said outer surface.

9. Device according to claim 6, wherein said regions of unevenness are in the form of helical elevations formed on said outer surface.

10. Device according to claim 6, wherein said regions of unevenness are in the form of helical depressions formed in said outer surface.

11. Device according to claim 1, wherein said turbine includes a tubular stator in which said rotor is inserted.

12. Device according to claim 11, wherein said stator has at least one nozzle formed therein for conducting compressed gas to said rotor, said at least one nozzle having an orientation with a tangential and an axial component relative to said rotor.

13. Device according to claim 11, including a compressed-gas feed canal, said at least one nozzle being in the form of a plurality of nozzles disposed along a peripheral curve of said stator for respectively causing clockwise and counterclockwise rotation of said rotor, said stator being rotatable for selectively bringing said nozzles into orientation with said feed canal.

14. Device according to claim 12, including a compressed-gas feed canal, said at least one nozzle being in the form of a plurality of nozzles disposed along a peripheral curve of said stator for respectively causing clockwise and counterclockwise rotation of said rotor, said stator being rotatable for selectively bringing said nozzles into orientation with said feed canal.

15. Device according to claim 11, wherein said rotor has a thread entrance end having a flange-like enlargement formed thereon overhanging said stator and preventing said rotor from slipping through said stator.

16. Device according to claim 11, including ball bearings supporting said rotor in said stator.

* * * * *